US011505909B1

(12) United States Patent
Thompson

(10) Patent No.: US 11,505,909 B1
(45) Date of Patent: Nov. 22, 2022

(54) BATTER PILING GUIDE

(71) Applicant: Lonnie E. Thompson, Perryville, MO (US)

(72) Inventor: Lonnie E. Thompson, Perryville, MO (US)

( * ) Notice: Subject to any disclaimer, the term of this patent is extended or adjusted under 35 U.S.C. 154(b) by 239 days.

(21) Appl. No.: 16/990,213

(22) Filed: Aug. 11, 2020

(51) Int. Cl.
*E02D 13/04* (2006.01)
*E02D 13/06* (2006.01)
*E02D 5/24* (2006.01)

(52) U.S. Cl.
CPC ..... *E02D 13/04* (2013.01); *E02D 5/24* (2013.01); *E02D 13/06* (2013.01)

(58) Field of Classification Search
CPC ..... E02D 5/24
See application file for complete search history.

(56) References Cited

U.S. PATENT DOCUMENTS 2,927,435 A 3/1960 Upson
3,754,403 A 8/1973 Mott

FOREIGN PATENT DOCUMENTS

CN 104567809 * 4/2015
GB 2115147 * 9/1983

* cited by examiner

*Primary Examiner* — Sean D Andrish
(74) *Attorney, Agent, or Firm* — Sanchelima & Associates, P.A.; Christian Sanchelima; Jesus Sanchelima

(57) ABSTRACT

A system for a batter piling guide including a base plate assembly and a level assembly is disclosed. The base plate assembly includes a base plate with a top portion and a bottom portion. The top portion includes a slit that has notches at predetermined locations. A level of the level assembly is secured to the base plate with fasteners. The fasteners are slidable within the slit and secured at desired notches that correspond with a desired angle. The angle setting is monitored for batter piles being driven into a ground surface. The base plate and level are in abutting contact with the batter piles and the desired angle remains constant if the batter pile is being driven properly.

11 Claims, 3 Drawing Sheets

BATTER PILING GUIDE

BACKGROUND OF THE INVENTION

1. Field of the Invention

The present invention relates to a batter piling guide and, more particularly, to a batter piling guide that facilitates the angle setting of batter piles during driving.

2. Description of the Related Art

Several designs for batter piling guides have been designed in the past. None of them, however, include the unique device construction such as the guiding base plate to be used in conjunction with a level.

Applicant believes that a related reference corresponds to U.S. Pat. No. 2,927,435A for offshore platforms. Applicant believes that another related reference refers to U.S. Pat. No. 3,754,403A for an offshore marine structure embodying anchor pile means. None of these references, however, teach of a guiding base plate used in conjunction with a level for facilitating the angle setting of batter piles during driving in an efficient and safe manner.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a batter piling guide that facilitates the angle setting of batter piles during driving.

It is another object of this invention to provide a batter piling guide that increases the safety of users as batter piles are being driven into a ground surface.

It is still another object of the present invention to provide a batter piling guide that can be retrofitted onto existing levels.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
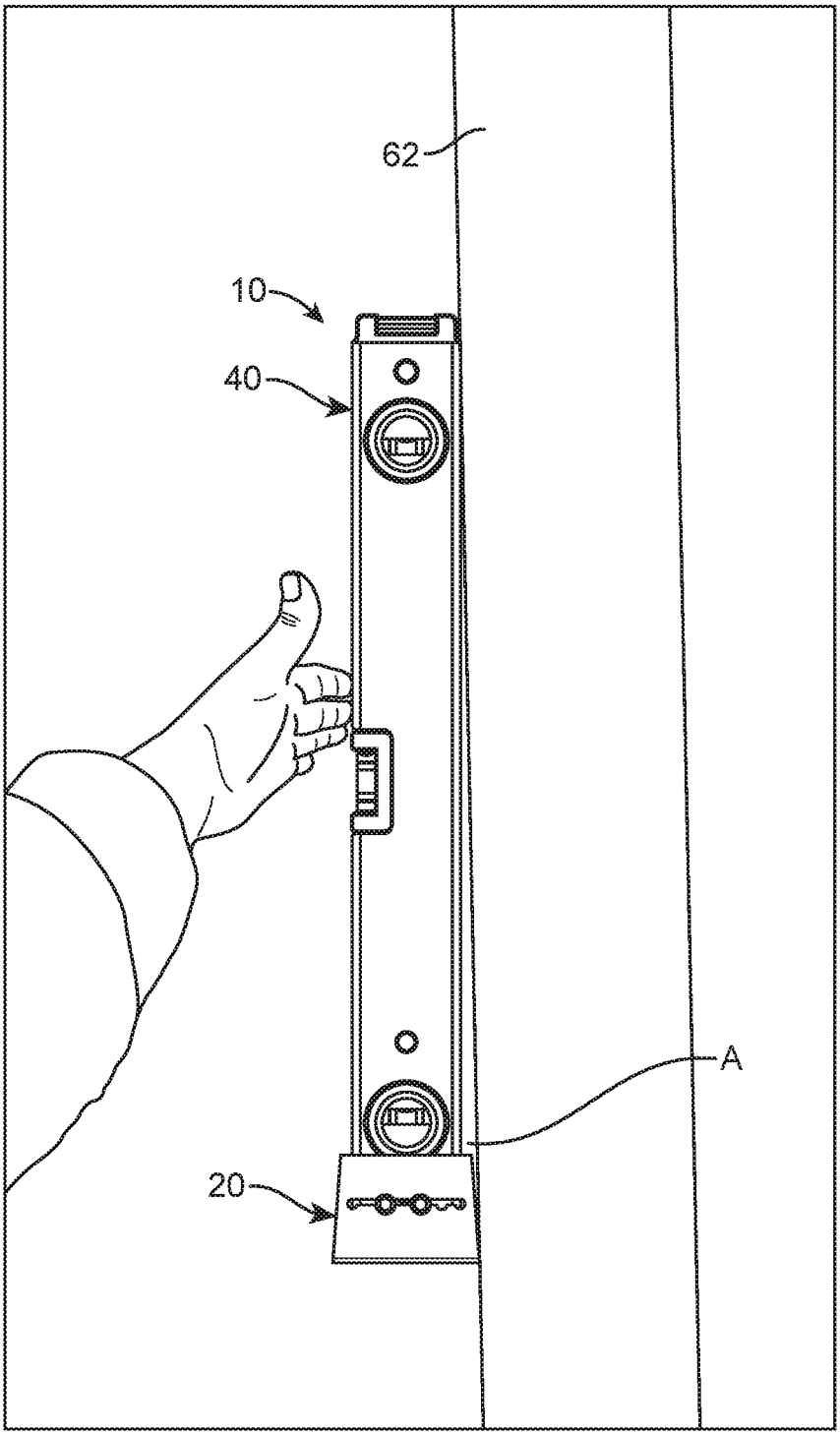
FIG. 1 represents an operational setting of batter piling guide 10.

Referring now to the drawings, where the present invention is generally referred to with numeral 10, it can be observed that it basically includes a base plate assembly 20 and a level assembly 40.

A batter piling guide 10, as best seen in FIG. 1, can be used to facilitate the angle setting of batter piles 62 during driving into a ground surface. It is to be understood that at least one of batter piles 62 may be suitable. Additionally, batter piling guide 10 allows for monitoring of batter piles 62 being driven in an efficient manner. Thereby increasing the safety of the user by requiring less time spent checking that the angle setting for driving of batter piles 62 is accurate. Batter piling guide 10 allows for users to maintain necessary equipment readily available to for measurements to expedite the process of driving of batter piles 62.

Figure 2:
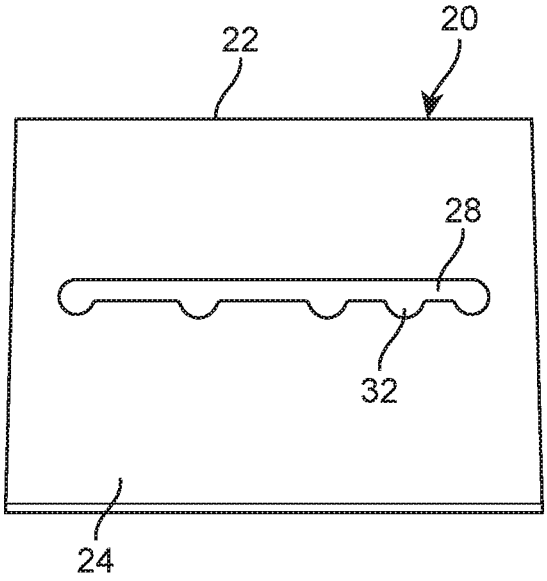
FIG. 2 shows a front view of the base plate assembly 20.
Figure 3:
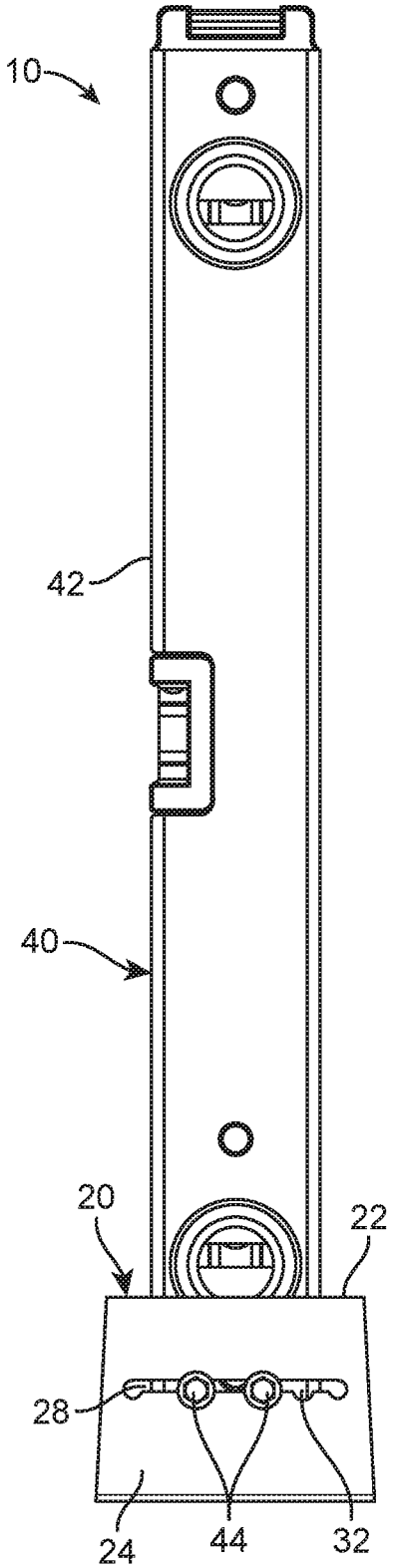
FIG. 3 illustrates a front view of the base plate assembly 20 secured to level assembly 40.
Figure 4:
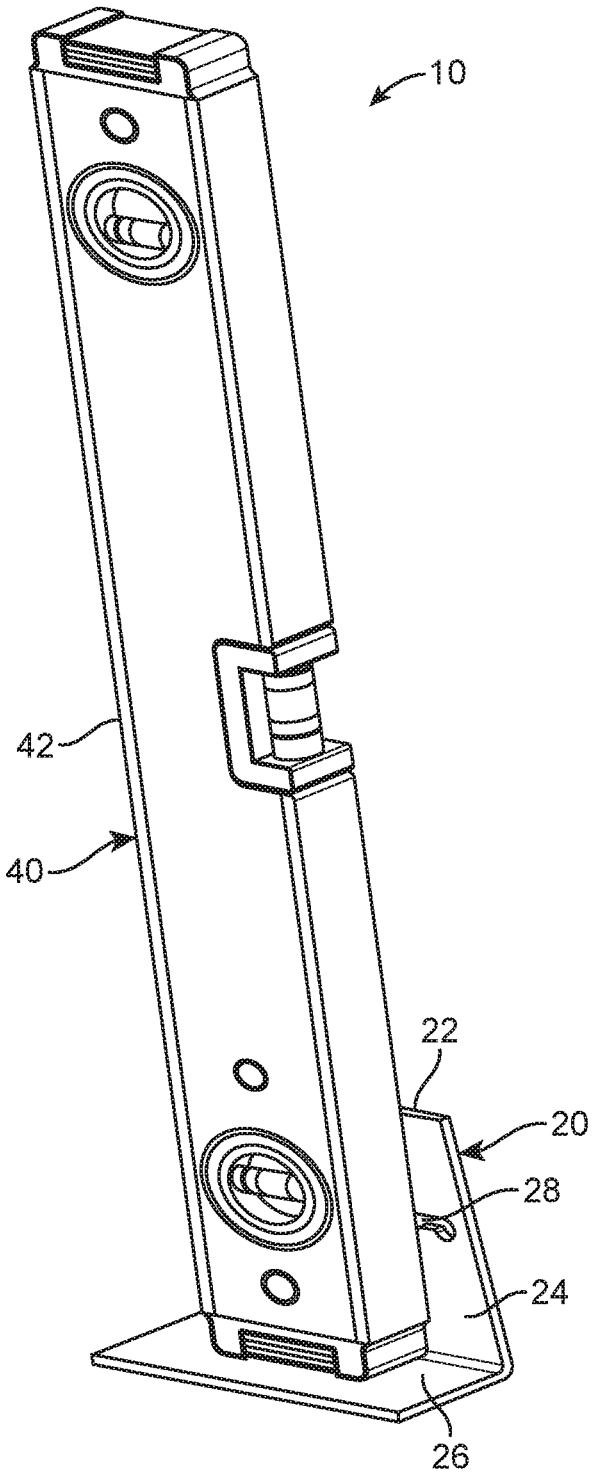
FIG. 4 is a representation of a rear view of the base plate assembly 20 secured to level assembly 40.

As best seen in FIGS. 2-4, base plate assembly 20 includes base plate 22. Base plate 22 may also be referred to as a guiding plate. Base plate 22 may be substantially in an L shaped configuration. It may be suitable for base plate 22 to be made of materials such as wood, plastic, metal, rubber, aluminum or the like. Referring to FIGS. 2-4, it can be seen that base plate 22 may include a top portion 24 and a bottom portion 26. In the preferred embodiment, top portion 24 and bottom portion 26 may be integral with one another. Top portion 24 and bottom portion 26 may be perpendicular to each other. Top portion 24 may be substantially larger than bottom portion 26, but both have a same width. Top portion 24 may be tapered, in one embodiment. Top portion 24 may have a top edge that is shorter than a bottom edge thereof. Bottom portion 26 may be rectangular shaped in one embodiment.

Importantly, top portion 24 may be used to secure base plate assembly 20 and level assembly 40 together. Top portion 24 may importantly include a slit 28. Slit 28 may extend a partial width of top portion 24. In one embodiment, slit 28 may be centrally located on top portion 24. It is to be understood that slit 28 may be entirely above of bottom portion 26. As best seen in FIGS. 2-3, slit 28 may include notches 32. Notches 32 may be located at predetermined locations along slit 28. In one embodiment, notches 32 may be along a bottom perimeter of slit 28. Notches 32 may be spaced apart parallel to each other on a same horizontal plane. Notches 32 may be used to angle level 42 of level assembly 40 at predetermined angles.

Level assembly 40, as best shown in FIG. 1, which includes level 42, may be secured onto base plate 22. It is to be understood that different levels may be retrofitted onto base plate 22. More specifically, level 42 may be secured onto top portion 24 and supported by bottom portion 26. It is to be understood that level 42 may be secured to base plate 22 with fasteners 44, as best seen in FIGS. 3-4. Fasteners 44 may be parallel to each other. Fasteners 44 may be perpendicular to top portion 24. It is to be understood that fasteners 44 may be screws, nails, buttons, snap buttons, hook and loop straps or other suitable fastening means. Level 42 may be in constant abutting contact with top portion 24 and bottom portion 26 simultaneously. Top portion 24 may extend a partial height of level 42. The bottom end of level 42 may be entirely supported on bottom portion 26.

Fasteners 44 may be received within slit 28 and secured on preselected of notches 32. Fasteners 44 may be slidable within slit 28 to be secured on different of notches 32. Depending on which of notches 32 fasteners 42 are secured on, level 42 may be angled differently. In one embodiment, there may be indicia adjacent to notches 32 to indicate the angle that corresponds with notches 32.

When base plate 22 and level 42 are secured together the setting of a desired angle A of batter piles 62 being driven into the ground can be easily monitored. It is to be understood that the bottom portion of level 42 may be secured to slit 28 with fasteners 44. Fasteners 44 may be slid along slit 28 to angle level 42 as needed. Level 42 and fasteners 44 may slide horizontally within slit 28. Fasteners 44 may be received with the desired of notches 32 that correspond with the needed setting for desired angle A for batter piles 62 that are being driven into the ground surface. Base plate 22 may be in constant abutting contact with batter piles 62, such that top portion 24 is parallel to batter piles 62 and bottom portion 26 is perpendicular to batter piles 62. The top portion of level 42 may be partially in abutting contact with batter piles 62. The bottom portion of level 42 secured to base plate 22 may be angled away from batter piles 62 as desired angle A is being measured, as best seen in FIG. 1. Desired angle A may preferably be substantially constant to indicate that batter piles 62 are being driven properly into the ground surface. The present invention makes measuring of desired angle A more efficient and safer as there is less time spent taking the needed measurements.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for batter piling guide, comprising:

a. a base plate assembly including a base plate formed by a top portion connected to a bottom portion to exhibit a chamfered edge, said base plate including a slit extending horizontally across a width of said top portion of said base plate, said slit has a substantially rectangular shape with rounded corners, said slit further including notches horizontally spaced apart at predetermined locations along said slit, said notches are semicircular cuts facing said bottom portion on a bottom edge of said slit;

b. a level assembly including a level, said level removably secured to said base plate upon said bottom portion with fasteners, said fasteners slidable within said slit and secured on said notches to angle said level at a desired angle; and c. at least one batter pile, said base plate and said level being in abutting contact with said at least one batter pile to measure the desired angle remaining consistent as said at least one batter pile is driven into a ground surface, said level angled away from said at least one batter pile.

2. The system of claim 1, wherein said level is secured adjacently to and in abutting contact with said top portion, said level being supported on said bottom portion.

3. The system of claim 1, wherein said top portion and said bottom portion have a same width, said top portion being larger than said bottom portion.

4. The system of claim 1, wherein said slit is centrally located on said top portion.

5. The system of claim 1, wherein said slit extends a partial length of said base plate.

6. The system of claim 1, wherein said notches are spaced apart upon said top portion.

7. The system of claim 1, wherein said fasteners are perpendicular to the width of said base plate.

8. The system of claim 1, wherein said top portion is parallel to said at least one batter pile.

9. The system of claim 1, wherein said bottom portion is perpendicular to said at least one batter pile.

10. The system of claim 1, wherein said notches are parallel to each other.

11. A system for batter piling guide, consisting of:

a. a base plate assembly including a base plate formed by a top portion connected to a bottom portion to exhibit a chamfered edge therebetween, said base plate including a slit extending horizontally across a width of said top portion of said base plate, said slit has a substantially rectangular shape with rounded corners, said slit further including notches horizontally spaced apart at predetermined locations along said slit, said notches are semicircular cuts facing said bottom portion on a bottom edge of said slit;

b. a level assembly including a level, said level removably secured to said base plate upon said bottom portion with fasteners, said fasteners slidable within said slit and secured on said notches to angle said level at a desired angle, said level is secured adjacently to and in abutting contact with said top portion; and c. at least one batter pile, said base plate and said level being in abutting contact with said at least one batter pile to measure the desired angle remaining consistent as said at least one batter pile is driven into a ground surface, said level angled away from said at least one batter pile.

* * * * *